US011746483B2

(12) United States Patent
Smieja et al.

(10) Patent No.: US 11,746,483 B2
(45) Date of Patent: Sep. 5, 2023

(54) ROTATING EDGE CUTTER FOR COLD PLANERS

(71) Applicant: Caterpillar Paving Products Inc., Brooklyn Park, MN (US)

(72) Inventors: Jameson Michael Smieja, Mound, MN (US); Nicholas B. Johnson, Dayton, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/506,430

(22) Filed: Oct. 20, 2021

(65) Prior Publication Data

US 2023/0120467 A1 Apr. 20, 2023

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 4,392,689 | A * | 7/1983 | Moore | E01C 23/0933 299/71 |
| 7,284,345 | B2 | 10/2007 | Schenk | |
| 10,024,006 | B2 * | 7/2018 | Noh | E01C 23/127 |
| 10,563,363 | B2 | 2/2020 | Barimani et al. | |
| 2005/0224063 | A1 * | 10/2005 | Sakita | B28D 1/121 125/15 |

FOREIGN PATENT DOCUMENTS

| | | | | |
|---|---|---|---|---|
| CN | 201351261 | | 11/2009 | |
| CN | 108193581 | A * | 6/2018 | |
| CN | 110004808 | A * | 7/2019 | E01C 23/088 |
| CN | 106869002 | | 1/2020 | |
| GB | 2246499 | A * | 2/1992 | A01B 45/00 |
| WO | WO-2008035966 | A2 * | 3/2008 | E01C 23/088 |

* cited by examiner

*Primary Examiner* — Janine M Kreck

(57) ABSTRACT

A milling machine can include a frame; a milling assembly coupled to the frame and including a drum housing and a cutting rotor located within the drum housing, the cutting rotor including a plurality of cutting bits configured to cut into a surface to define a cut surface; and a secondary edge cutter separate from the plurality of cutting bits and located to cut an edge of the cut surface such that the edge of the cut surface cut by the secondary edge cutter defines a sharper edge than the edge of the cut surface cut by the plurality of cutting bits.

12 Claims, 9 Drawing Sheets

ROTATING EDGE CUTTER FOR COLD PLANERS

TECHNICAL FIELD

The present disclosure generally relates to a milling machine. More particularly, the present disclosure relates to a milling assembly of a milling machine.

BACKGROUND

Cold planers are milling machines used to remove at least part of a surface of a paved area such as a road, bridge, or parking lot. Typically, cold planers include a frame, a power source, a milling assembly positioned below the frame, and a conveyor system. The milling assembly includes a cutting rotor having numerous cutting bits disposed thereon. As power from the power source is transferred to the milling assembly, this power is further transferred to the cutting rotor, thereby rotating the cutting rotor about its axis. As the rotor rotates, its cutting bits engage the hardened asphalt, concrete, or other materials of an existing surface of a paved area, thereby removing layers of these existing structures. The spinning action of the cutting bits transfers these removed layers to the conveyor system which transports the removed material to a separate powered machine such as a haul truck for removal from a work site.

In cold planers, the ends of the cutting rotors are designed to cut a square edge in the existing asphalt. However, there is often breakage at the top edge of the cut that is undesirable. In addition, it can also be difficult to fully contain all the cut material in the drum housing, and some material can leak out and be left at the lower inside corners of the cut.

CN10686900 discusses a cutting rotor having detachable and replaceable side cutter assemblies.

SUMMARY

In an example according to this disclosure, a milling machine can include a frame; a milling assembly coupled to the frame and including a drum housing and a cutting rotor located within the drum housing, the cutting rotor including a plurality of cutting bits configured to cut into a surface to define a cut surface; and a secondary edge cutter separate from the plurality of cutting bits and located to cut an edge of the cut surface such that the edge of the cut surface cut by the secondary edge cutter defines a sharper edge than the edge of the cut surface cut by the plurality of cutting bits.

In one example, a milling assembly can include a drum housing including a discharge port, a cutting rotor located within the drum housing, the cutting rotor including a plurality of cutting bits configured to cut into a surface to define a cut surface; and a secondary edge cutter separate from the plurality of cutting bits and located to cut an edge of the cut surface such that the edge of the cut surface cut by the secondary edge cutter defines a sharper edge with less surface material breakaway than the edge of the cut surface cut by the plurality of cutting bits.

In one example, a method of milling a surface can include rotating a cutting rotor such that a plurality of cutting bits cut into the surface to define a cut surface; and rotating a secondary edge cutter separate from the plurality of cutting bits and located to cut an edge of the cut surface such that the edge of the cut surface cut by the secondary edge cutter defines a sharper edge with less surface material breakaway than the edge of the cut surface cut by the plurality of cutting bits.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
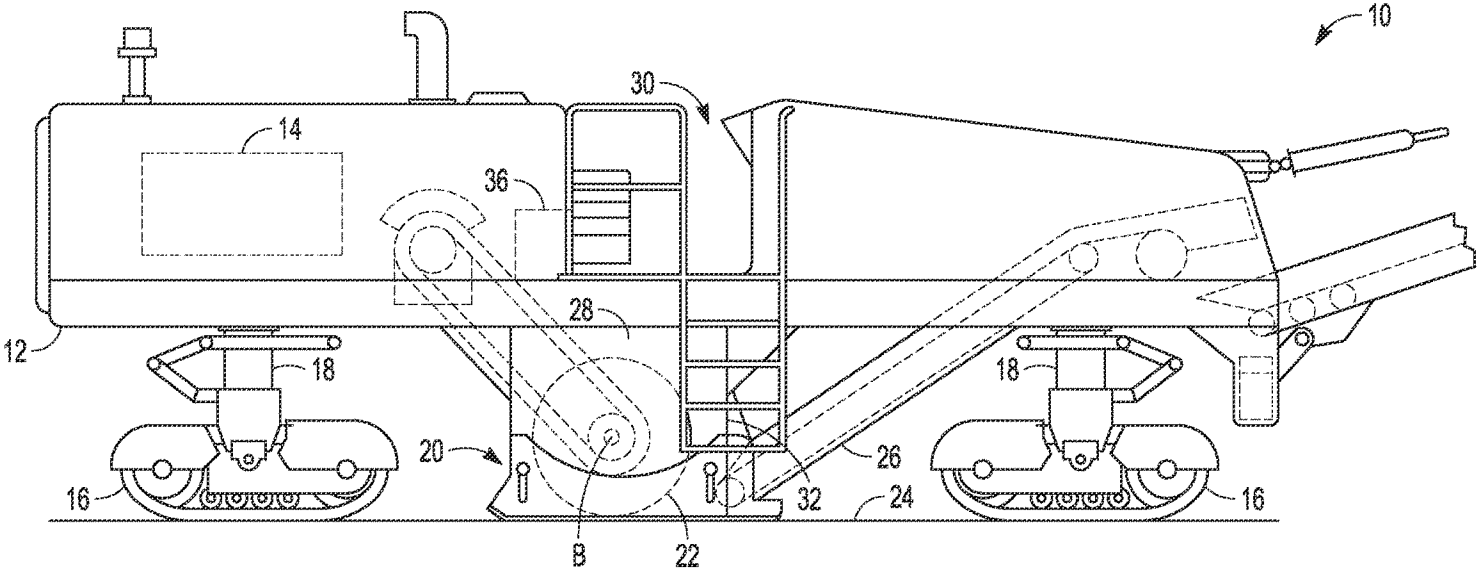
FIG. 1 shows a side view of a cold planer, in accordance with one embodiment.

FIG. 1 shows a side view of a milling machine such as a cold planer 10, in accordance with one embodiment. The cold planer 10 includes a frame 12, and a power source 14 connected to the frame 12. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows to move the cold planer 10 in a forward direction over a ground surface 24, for example a paved road or aground already processed by the cold planer 10. For example, in the shown embodiment, the transportation devices 16 are configured as track assemblies. The lifting columns 18 are configured to raise and lower the frame 12 relative to the transportation devices and the ground surface 24.

The cold planer 10 further includes a milling assembly 20 connected to the frame 12. The milling assembly 20 includes a drum housing 28 holding a rotatable cutting rotor 22 operatively connected to the power source 14. The cutting rotor 22 can be rotated about a drum or housing axis B extending in a direction perpendicular to the frame axis. As the rotatable cutting rotor 22 spins about its drum axis B, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the cutting rotor 22 and its cutting bits then transfers the hardened materials to a first stage conveyor 26 via a discharge port 32 on the drum housing 28. The first stage conveyor 26 can be coupled to the frame 12 and located at or near the discharge port 32.

The drum housing 28 includes front and rear walls, and a top cover positioned above the cutting rotor 22. Furthermore, the drum housing 28 includes lateral covers on the left and right sides of the cutting rotor 22 with respect to a travel direction of the cold planer 10. The drum housing 28 is open toward the ground surface 24 so that the cutting rotor 22 can engage in the ground surface 24 from the drum housing 28.

The cold planer 10 further includes an operator station or platform 30 including an operator interface for inputting commands to a control system, including a controller 36, for controlling the cold planer 10, and for outputting information related to an operation of the cold planer 10. The controller 36 can include combinations of hardware and software to receive, analyze, and transmit data, information, and instructions to various components of the milling machine.

Figure 2:
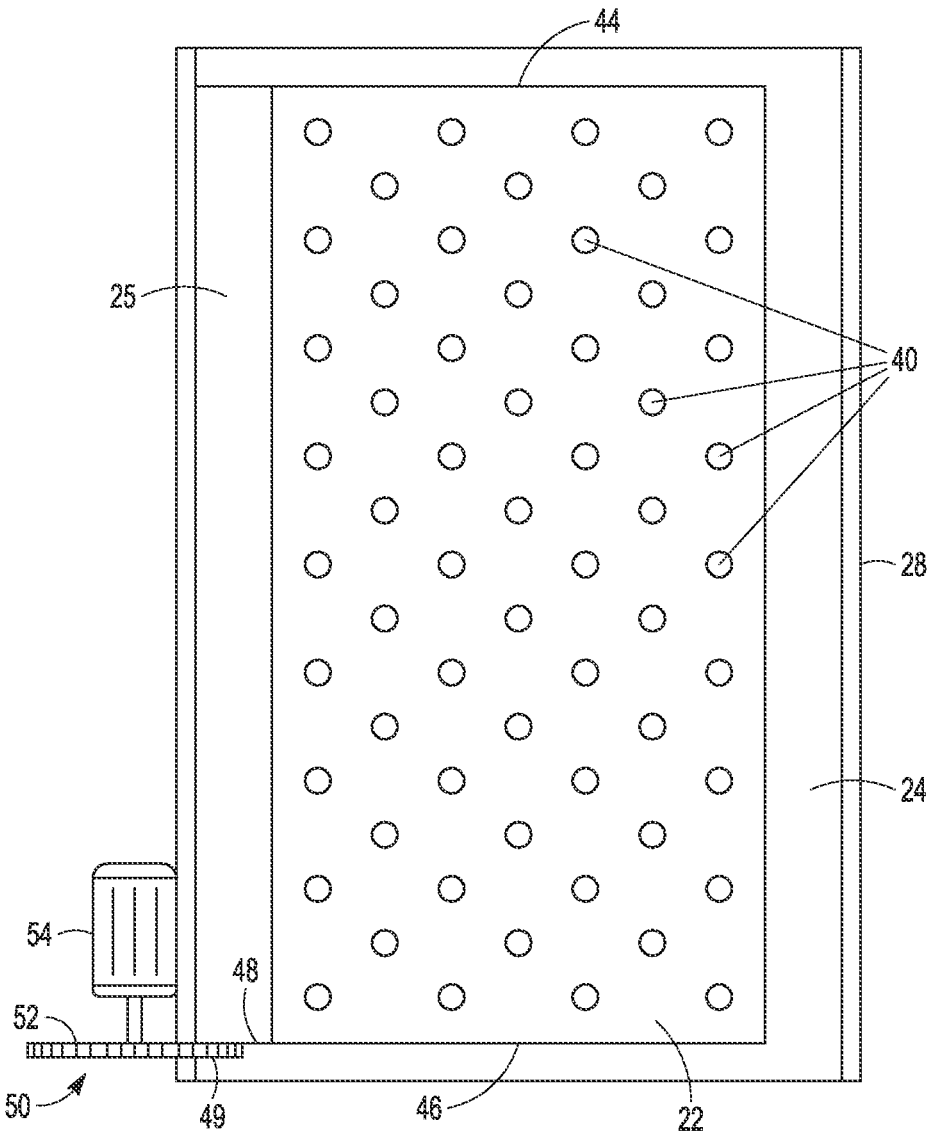
FIG. 2 shows atop view of a cutting rotor, in accordance with one embodiment.
Figure 3:
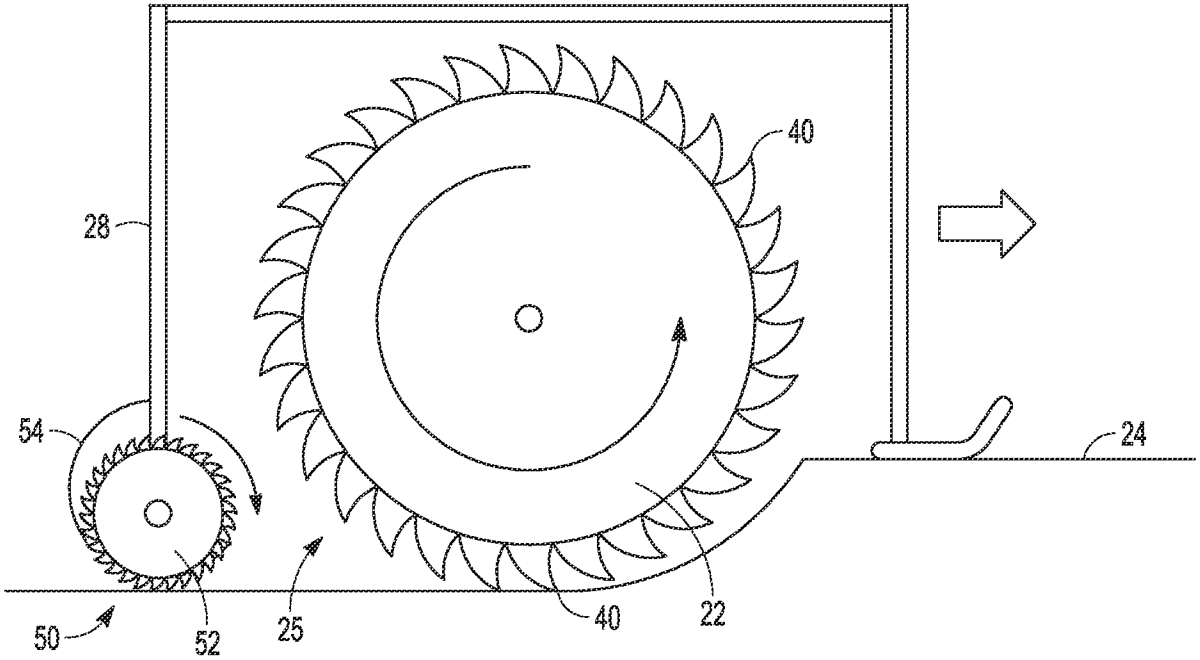
FIG. 3 shows a side view of the cutting rotor of FIG. 2, in accordance with one embodiment.

FIG. 2 shows a top view of the cutting rotor 22, in accordance with one embodiment; and FIG. 3 shows a side view of the cutting rotor 22.

In this example, the cutting rotor 22 can include a plurality of cutting bits 40 positioned around an outer surface 42 of the cutting rotor 22. The cutting bits 40 can be located across a width of the cutting rotor 22 from a first end 44 to a second end 46 of the cutting rotor 22. The plurality of cutting bits 40 can be configured to cut into the surface 24 to define a cut surface 25 having a first cut edge 48 which is cut by the plurality of cutting bits 40.

As noted, the ends of typical cutting rotors are designed to cut a square edge in the existing asphalt. However, often there can be breakage at the top edges of the cut surface 25 that is undesirable. In addition, it can also be difficult to fully contain all the cut material in the drum housing 28, and some material can leak out and be left at the lower inside corners of the cut. This is also undesirable.

Accordingly, the present system provides a secondary cutter 50 to provide a sharp, clean edge. The secondary edge cutter 50 can be separate from the plurality of cutting bits 40 and located and positioned to further cut a second edge cut 49 of the cut surface 25 such that the edge cut 49 of the cut surface 25 cut by the secondary edge cutter 50 defines a sharper edge cut than edge cut 48.

Figure 4:
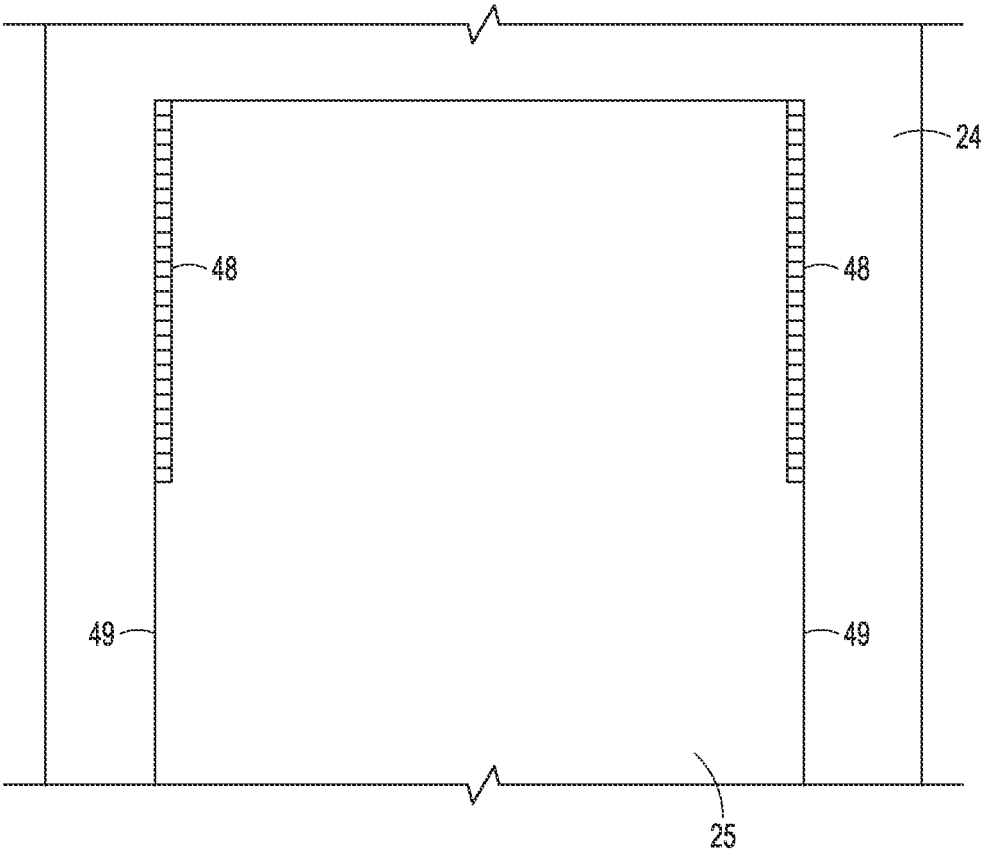
FIG. 4 shows a top view of a cut surface.

For example, FIG. 4 shows a top view of the cut surface 25 cut out of surface 24. The first edge cut 48 produced by the cutting bits 40 can be rough and include breakaway portions. The secondary cutter 50 makes a sharper edge cut 49 with less material breakaway than the edge cut 48 of the cut surface 25 cut by the plurality of cutting bits 40. So, the cutting rotor 22 makes the first cut to define a cut surface 25 having rough cut edges 48, then the secondary edge cutter 50 makes a finer cut at that cut edge 48 and defines the second cut edge 49 which has a sharper, cleaner profile than the first edge cut 48.

Referring again to FIGS. 2 and 3, although only one secondary edge cutter 50 is shown, there can be a secondary edge cutter 50 on both sides of the cutting rotor 22.

In general, the secondary edge cutter 50 can include a powered cutting wheel 52 separate from cutting rotor 22 and at least partially located within the drum housing 28. If the cutting wheel 52 is at least partially in the drum housing, any material cut by the secondary edge cutter 50 can be picked up and discharged via the cutting rotor 22. In some examples, the secondary edge cutter 50 can be completely within or completely outside the drum housing 28. The cutting wheel 52 can be positioned so that a lower edge of the cutting wheel 52 is at the same level as the lower edge of the cutting bits 40.

In one example, the cutting wheel 52 can be located in front of cutting rotor 22 to score the surface 24, and then when the plurality of cutting bits 40 take away the broken material, a clean, sharp edge up to the scored line defined by the cutting wheel 52 will be left.

In one example, the cutting wheel 52 can be a flat, planar, diamond edged cutting wheel. For example, the cutting wheel 52 can be a standard diamond asphalt/concrete circular saw blade.

In one example, the powered cutting wheel 52 can rotate in an opposite direction from the cutting rotor 22. For example, as shown in FIG. 3, if the cutting rotor 22 has a counterclockwise upward cut, then the cutting wheel 52 can have a clockwise downward cut into the surface 24. This provides a cleaner and sharper edge cut. The spinning cutting wheel 52 does a better job producing the final edge cut after the main cutting rotor 22 than the cutting bits 40 alone.

As noted, another alternative can include adding the same horizontally mounted cutting wheel 52 in front of the cutting rotor 22 (instead of behind), with the intent to simply score the asphalt road surface 24 just before the surface is cut with the cutting rotor 22 and aid in producing a sharper edge cut with less breakaway. This can be accomplished using a cutting wheel 52 that cuts at a shallower depth than the cutting rotor 22, as only a minimal depth of cut is necessary to prevent material from breaking off the finished corner.

Figure 5:
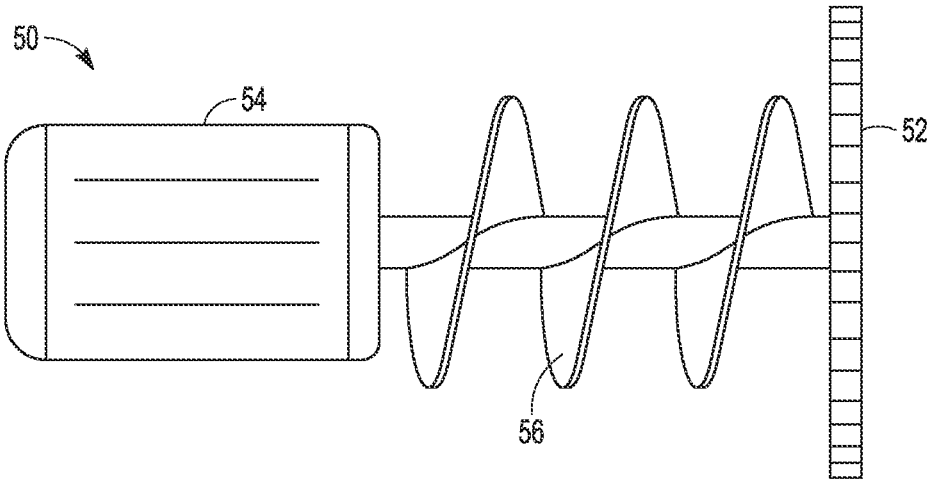
FIG. 5 shows a side view of an auger structure, in accordance with one embodiment.

FIG. 5 shows a side view of an auger structure 56, in accordance with one embodiment. In this example, the secondary edge cutter 50 can further include a helical shaped, auger structure 56 to draw material away from the edge of the cut. The auger structure 56 will draw the material away from the cutting wheel 52 towards the center of the cut where it can be picked up by the cutting rotor to be discharged from the drum housing. Accordingly, the auger structure 56 serves to draw the material away from the outer edges of the drum housing 28 that are more prone to material leakage.

Figure 6:
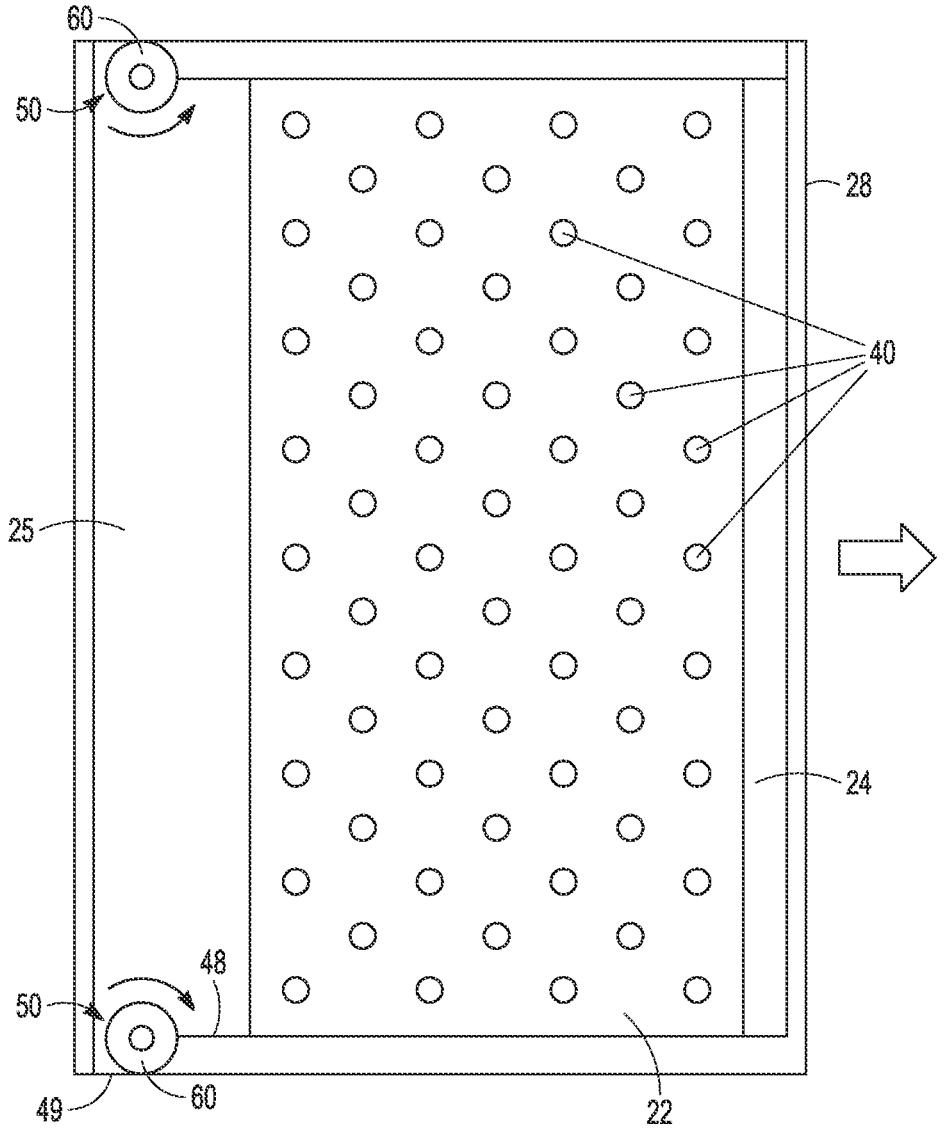
FIG. 6 shows a top view of a cutting rotor, in accordance with one embodiment.
Figure 7:
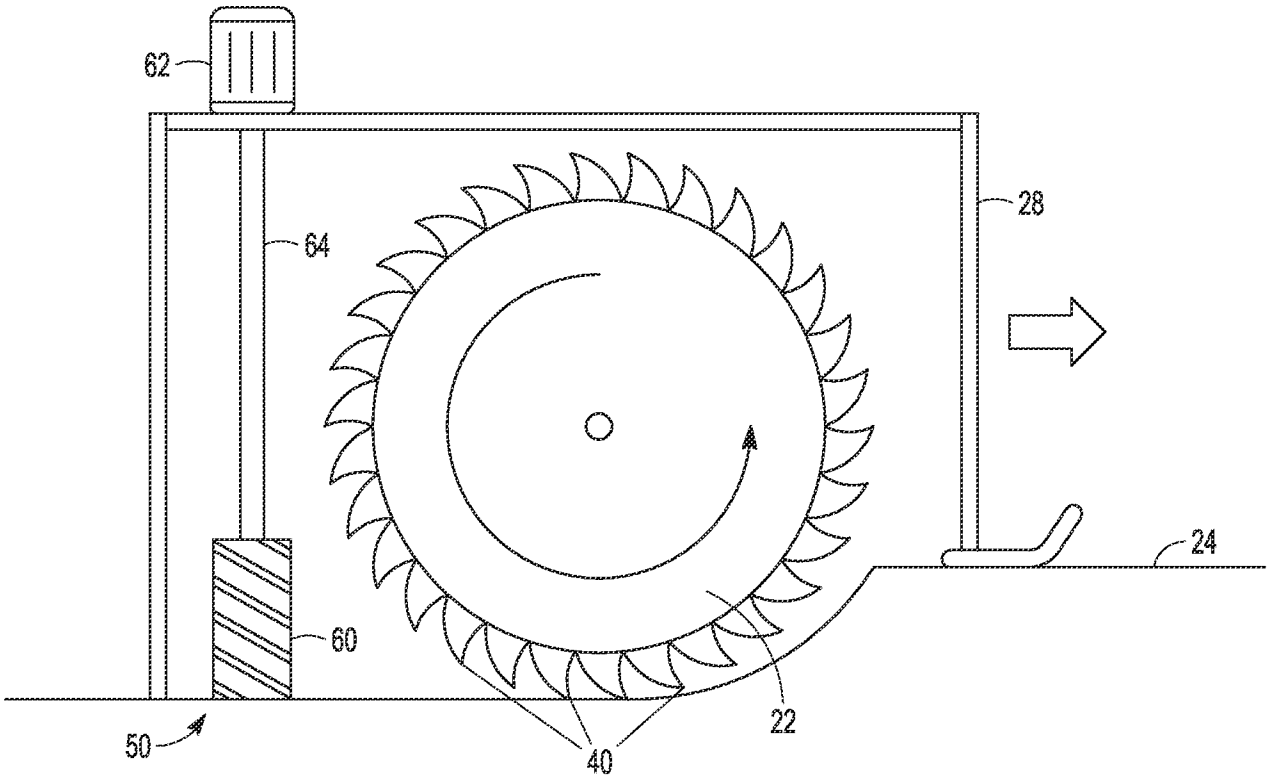
FIG. 7 shows a side view of the cutting rotor of FIG. 6, in accordance with one embodiment.

FIG. 6 shows a top view of the cutting rotor 22, in accordance with one embodiment; and FIG. 7 shows a side view of the cutting rotor 22.

In this example, the secondary edge cutter 50 can include a vertical, rotating cutting bit 60 with a cutting edge, (e.g., an end mill cutter). The cutting bit 60 can be positioned to cut away the ragged edge of the edge cut 48 left by the cutting bits 40 to define a sharp edge cut 49. The cutting bit 60 can be powered by a motor 62 driving a shaft 64. In one example, the motor 62 can be located above the drum housing 28 and the shaft 64 can run down through the drum housing 28 to drive the cutting bit 60. The cutting bit 60 can be positioned so that a bottom of the cutting bit 60 is at the same level as the bottom of the cutting bits 40.

In one example, the rotating cutting bit 60 can be configured to rotate so as to cut into the cut edge. Thus, on the right side of the cutting rotor 22 the cutting bit rotates clockwise, and on the left side of the cutting rotor 22 the cutting bit rotates counter-clockwise. As with the cutting wheel discussed above, the cutting bit 60 can be setup to produce a sharper edge cut 49 with less breakaway than just the cut edge 48 produced using the cutting bits 40.

Figure 8:
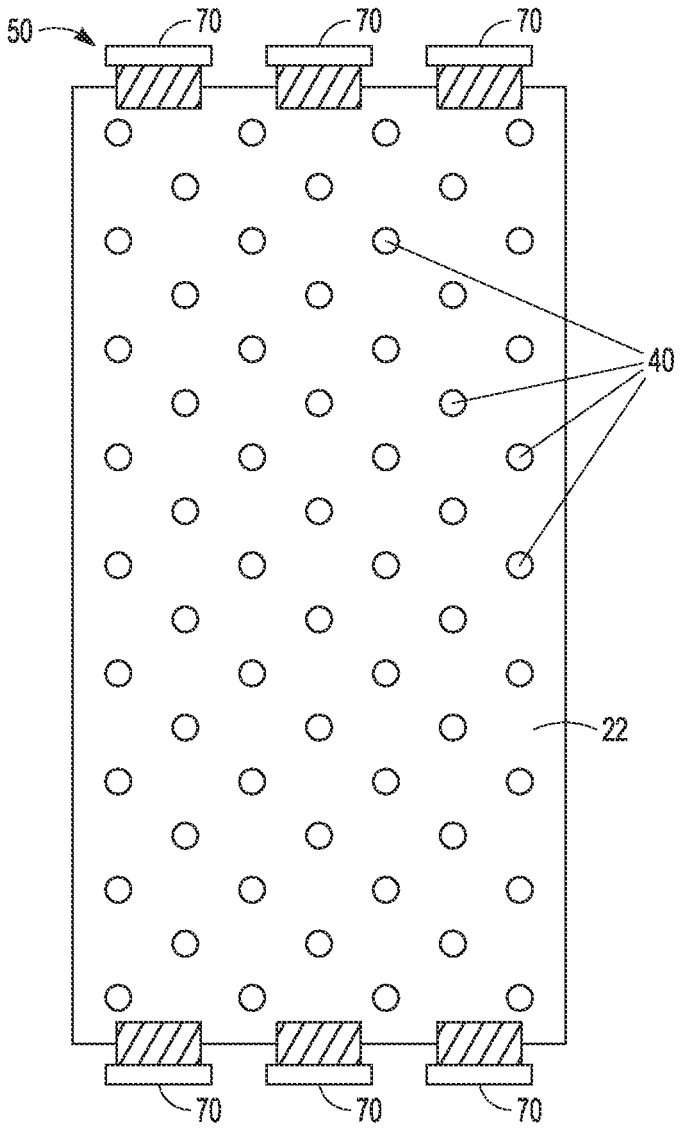
FIG. 8 shows a top view of a cutting rotor, in accordance with one embodiment.
Figure 9:
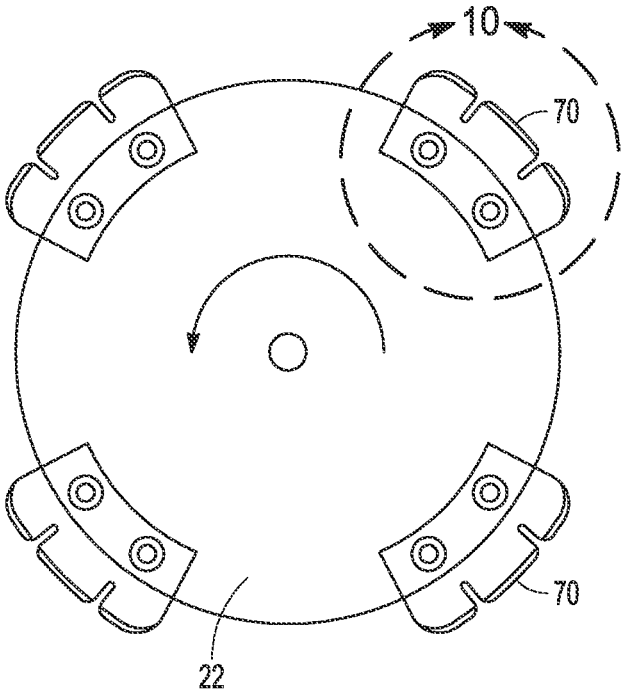
FIG. 9 shows a side view of the cutting rotor of FIG. 8, in accordance with one embodiment.
Figure 10:
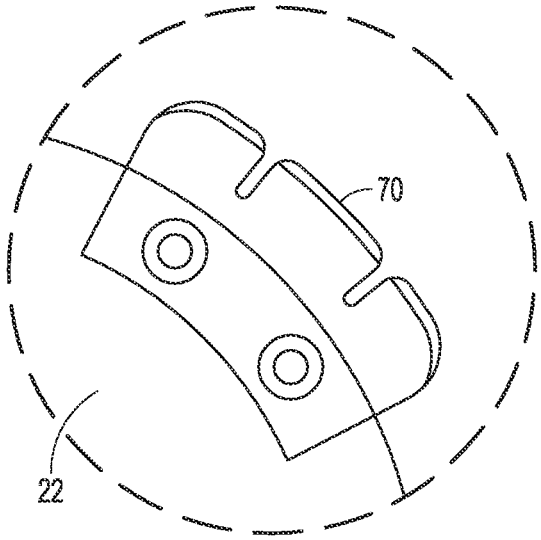
FIG. 10 shows a detail of a cutting blade, in accordance with one embodiment.

FIG. 8 shows a top view of the cutting rotor 22, in accordance with one embodiment; FIG. 9 shows a side view of the cutting rotor 22; and FIG. 10 shows a detail of a cutting blade 70, in accordance with one embodiment.

Here, the secondary edge cutter 50 includes a cutting blade 70 affixed to an end surface of the cutting rotor 22 and positioned farther out than any of the plurality of cutting bits 40. The cutting blade 70 can be a segment of a diamond saw wheel and be mounted directly to the rotor end rings, thereby aiding in producing a sharper edge cut than the typical end ring design which utilizes cutting bits only.

The cutting blade 70 can be directly bolted to the outer end ring surface of the cutting rotor 22. The cutting blade 70 can be an arc-shaped, rounded blade. For example, a segment of the cutting wheel 52, discussed above. As the cutting bits 40 cut up the surface, the cutting blades 70 can make a fine, sharp cut at the outer edge of the primary cut to result in a final sharp edge.

INDUSTRIAL APPLICABILITY

The present system is applicable to a milling assembly for a cold planer. The system can also be applicable to a reclaimer or other milling machine. The goal is to produce a fine cut with less breakaway on the final cut edge than on the primary cut.

Figure 11:
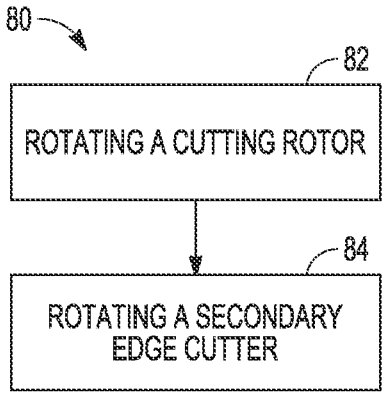
FIG. 11 shows a flow chart of a method of milling a surface, in accordance with one embodiment.

FIG. 11 shows a flow chart of a method (80) of milling a surface, in accordance with one embodiment.

The method (80) can include rotating a cutting rotor (82) such that a plurality of cutting bits cut into the surface to define a cut surface; and rotating a secondary edge cutter (84) separate from the plurality of cutting bits and located to cut an edge of the cut surface such that the edge of the cut surface cut by the secondary edge cutter defines a sharper edge with less surface material breakaway than the edge of the cut surface cut by the plurality of cutting bits.

In some examples, rotating a secondary edge cutter includes rotating a powered cutting wheel separate from cutting rotor. In one embodiment, rotating a secondary edge cutter includes rotating a vertical, rotating cutting bit. In one embodiment, rotating a secondary edge cutter includes cutting blades affixed to an end surface of the cutting rotor and positioned farther out than any of the plurality of cutting bits.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A milling machine comprising:

a frame;

a milling assembly coupled to the frame and including a drum housing and a cutting rotor located within the drum housing, the cutting rotor including a plurality of cutting bits configured to cut into a surface to define a cut surface having a first cut edge; and a secondary edge cutter including a planar circular saw blade separate from the plurality of cutting bits and located behind the cutting rotor to cut the first cut edge to form a second cut edge of the cut surface, wherein the planar circular saw is configured to provide a finer cut than the plurality of cutting bits such that the second cut edge of the cut surface cut by the secondary edge cutter defines a sharper edge profile than the first cut edge of the cut surface cut by the plurality of cutting bits.

2. The milling machine of claim 1, wherein the secondary edge cutter includes a powered cutting wheel separate from cutting rotor and at least partially located within the drum housing.

3. The milling machine of claim 2, wherein the cutting wheel includes a helical shaped structure to draw material away from the edge.

4. The milling machine of claim 2, wherein the wherein the cutting wheel is a flat, planar, diamond edged cutting wheel.

5. The milling machine of claim 2, wherein the powered cutting wheel rotates in an opposite direction from the cutting rotor.

6. The milling machine of claim 1, wherein the milling machine comprises a cold planer.

7. A milling assembly comprising:

a drum housing including a discharge port;

a cutting rotor located within the drum housing, the cutting rotor including a plurality of cutting bits configured to cut into a surface to define a cut surface having a first cut edge; and a secondary edge cutter including a planar circular saw blade separate from the plurality of cutting bits and located behind the cutting rotor to cut the first cut edge to form a second cut edge of the cut surface, wherein the planar circular saw is configured to provide a finer cut than the plurality of cutting bits such that the second cut edge of the cut surface cut by the secondary edge cutter defines a sharper edge profile with less surface material breakaway than the first cut edge of the cut surface cut by the plurality of cutting bits.

8. The milling assembly of claim 7, wherein the secondary edge cutter includes a powered cutting wheel separate from cutting rotor and at least partially located within the drum housing.

9. The milling assembly of claim 8, wherein the cutting wheel includes a helical shaped structure to draw material away from the edge.

10. The milling assembly of claim 8, wherein the powered cutting wheel rotates in an opposite direction from the cutting rotor.

11. A method of milling a surface, the method comprising:

rotating a cutting rotor such that a plurality of cutting bits cut into the surface to define a cut surface having a first cut edge; and rotating a secondary edge cutter including a planar circular saw blade separate from the plurality of cutting bits and located behind the cutting rotor to cut the first cut edge to form a second cut edge of the cut surface, wherein the planar circular saw is configured to provide a finer cut than the plurality of cutting bits such that the second cut edge of the cut surface cut by the secondary edge cutter defines a sharper edge profile with less surface material breakaway than the first cut edge of the cut surface cut by the plurality of cutting bits.

12. The method of claim 11, wherein rotating a secondary edge cutter includes rotating a powered cutting wheel separate from cutting rotor.

* * * * *